US006257028B1

(12) United States Patent
Russkamp

(10) Patent No.: US 6,257,028 B1
(45) Date of Patent: Jul. 10, 2001

(54) DEVICE FOR TREATING A STRIP OF FABRIC

(75) Inventor: Dieter Russkamp, Mönchengladbach (DE)

(73) Assignee: Eduard Kusters Maschinenfabrik GmbH & Co. KG, Krefeld (DE)

( * ) Notice: Subject to any disclaimer, the term of this patent is extended or adjusted under 35 U.S.C. 154(b) by 0 days.

(21) Appl. No.: 09/381,074

(22) PCT Filed: Feb. 28, 1998

(86) PCT No.: PCT/DE98/00590

§ 371 Date: Dec. 3, 1999

§ 102(e) Date: Dec. 3, 1999

(87) PCT Pub. No.: WO98/40548

PCT Pub. Date: Sep. 17, 1998

(30) Foreign Application Priority Data

Mar. 12, 1997 (DE) ..... 197 10 168

(51) Int. Cl.[7] ..... D06B 3/22
(52) U.S. Cl. ..... 68/158; 68/175; 68/903
(58) Field of Search ..... 68/355, 43, 158, 68/175, 903

(56) References Cited

U.S. PATENT DOCUMENTS 2,963,893 * 12/1960 Kusters ..... 68/3 SS X
3,700,404 * 10/1972 Janisch et al. ..... 68/903 X
3,774,419 * 11/1973 Appenzeller ..... 68/158
5,768,919 * 6/1998 Kurschatke ..... 68/158 X

FOREIGN PATENT DOCUMENTS 11 13 201 8/1961 (DE) .
44 13 871 1/1995 (DE) .

* cited by examiner

*Primary Examiner*—Philip R. Coe
(74) *Attorney, Agent, or Firm*—Kenyon & Kenyon

(57) ABSTRACT

The treatment device includes a container for a treatment fluid, in which a drum around which the web loops rotates eccentrically. The drum is made up of axis-parallel, hollow, sealed rods and possesses a drum shaft structured as a hollow shaft, which together produce a buoyancy which makes up a significant part of the weight of the drum and the drum shaft. The drum is suspended at one end via stretchably elastic drive belts, and at the other end on tension springs, which catch the remaining weight. The drum shaft is eccentrically mounted on an eccentric shaft. The eccentric shaft is provided with equalization weights. All of the measures act together to allow low-vibration operation, towards the outside, of the treatment device.

10 Claims, 2 Drawing Sheets

0
1
1'
1"
2
5
6
7
8
9
9'
10
11
11
12
13
14
15
15'
15"
16
18
20
20'
20"
21
22
23
24
25
26
27
28
28
29
29'
30
31
32
33
34
35
A
F1
W
W
II
II

DEVICE FOR TREATING A STRIP OF FABRIC

BACKGROUND OF THE INVENTION

The invention relates to a treatment device for a continuously moving web. The device has a machine frame and a container that is supported in the machine frame to hold a treatment fluid and has a drum that can rotate in the container in the treatment fluid. This drum has a cylindrical, fluid-permeable circumference, at the bottom of which the web rests against the region which is immersed in the container, at a looping angle of at least, and further has a driven eccentric shaft which is rotationally mounted in fixed external bearings. Also provided is a drum shaft that carries the drum, eccentrically mounted on the eccentric shaft, structured as a hollow shaft, and surrounding the eccentric shaft, which is rotationally mounted at its ends on regions of the eccentric shaft that are eccentric to the axis of rotation of the eccentric shaft.

Such a treatment device is described in German Patent 11 13 201. The rotating eccentric shaft has regions eccentric to its axis of rotation, on which the drum shaft is mounted by means of roller bearings. As the eccentric shaft rotates, the drum shaft and therefore the drum supported on it perform an eccentric movement. At the same time, the drum rotates, in which connection it can be entrained by the web, but also can itself be driven. The web surrounds the drum and is moved back and forth in the treatment fluid contained in the container, as the drum performs its eccentric movement, perpendicular to the plane of the fluid, thereby resulting in an increased bath exchange and an improved treatment effect, particularly washing effect.

Because of the eccentric movement of the drum, strong vibrations occur, which made a special foundation necessary for the known device. In addition, the parts of the device were subject to significant alternating stresses over an extended period of time, which placed special demands on the material.

SUMMARY OF THE INVENTION

The invention is based on the task of reducing the vibration related problems present in prior art devices of the type set forth above. The present invention improves on existing designs by providing that the drum shaft be supported on the machine frame at both ends, an an elastically resilient manner, in a plane perpendicular to its axis.

In this way, the mounting of the drum shaft on the eccentric shaft can be relieved of part of the weight of the drum, and the drum shaft can be relieved of part of the mass forces. The mass forces of the drum and the drum shaft which are passed on to the eccentric shaft are passed on to the machine stand, in damped manner. This already achieves a significant improvement in the effects of vibrations.

In the preferred embodiment, the drum shaft is suspended on the machine stand in elastically resilient manner, i.e. the elastically resilient support is located above the drum shaft and is subject to tensile stress.

According to another important aspect of the invention, the hollow elements, namely the rods and the drum shaft, form buoyancy elements which can take over a significant part of the weight of the drum and the drum shaft when the drum is immersed in the treatment fluid in its operating state.

The hollow rods are actually known from German Patent 44 13 871 C1, but they deviate from the state of the art of the preamble with regard to the mounting of the drum and the production of the eccentric movement.

In another aspect of the invention, if the drum has an endless stretchably elastic pulling drive element, such as a belt or several parallel round belts, this pulling drive element can simultaneously serve as an elastic support which catches at least part of the weight of the drum and the drum shaft.

The drive is provided at only one end of the drum. At the other end, the elastic support can be formed such that the drum shaft carries a pivot bearing at that end, which is supported on the machine frame via by springs, particularly by tension springs.

Another aspect of the invention concerns the buoyancy volume and the stress on the stretchably elastic supports on the two ends of the drum shaft. The volume of the drum shaft and the rods which is immersed in the treatment fluid is sized in such a way that at the typical operational immersion depth, the buoyancy is 70 to 90% of the weight of the drum and the drum shaft), while the remaining weight is carried by the stretchably elastic pulling drive element at the one end and the springs at the other end of the drum shaft. Hence, a significant part of the weight of the drum and the drum shaft are therefore equalized by the buoyancy, while only a small part is to be caught by the stretchably elastic support.

To reduce the development of vibrations, equalization masses are provided at the eccentric shaft in the vicinity of the eccentric regions. (Such equalization masses on treatment devices of the type in question are known.)

A significant aspect of the present invention is the combination of the aforementioned characteristics, namely utilization of the buoyancy of the drum and the drum shaft, the elastically resilient support of the two ends of the drum shaft, and the equalization masses on the eccentric shaft. These characteristics, in combination, result in a device which gives off hardly any significant vibrations to the environment in operation, and in particular no longer requires a complicated, separate foundation.

BRIEF DESCRIPTION OF THE DRAWING

The drawings illustrate one embodiment of the present invention, in which.

DETAILED DESCRIPTION OF THE INVENTION

Figure 1:
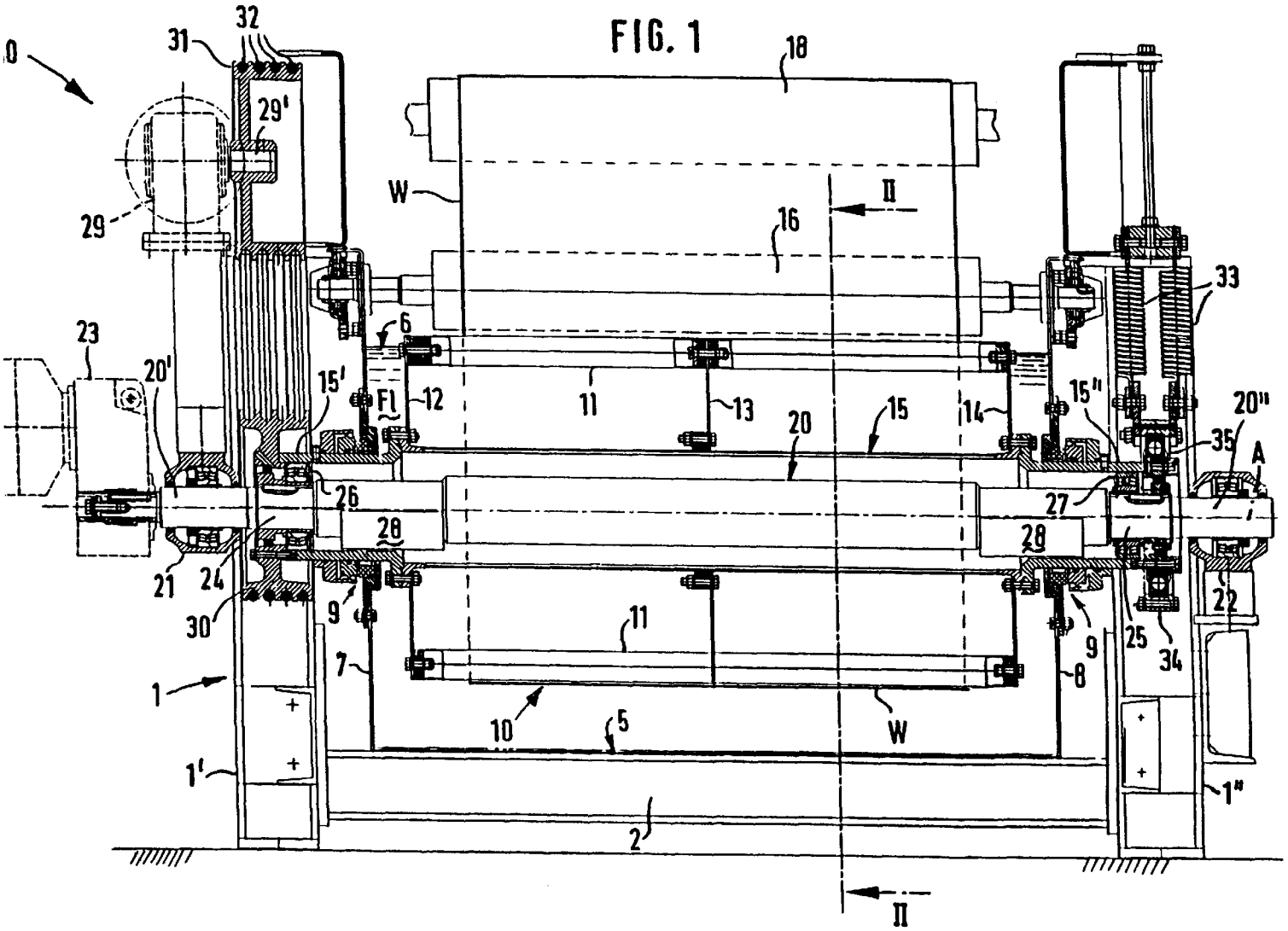
FIG. 1 shows a vertical cross-section through the device.

The treatment device, designated as a whole as 100 in FIG. 1, includes a machine frame 1 which possesses two side cheeks 1', 1" which lie parallel, upright, and opposite one another and are connected with one another by cross-beams 2, 3, 4. A container 5, open toward the top and approximately U-shaped in cross-section, extends between side cheeks 1', 1"; it is supported by cross-beams 2, 3, 4 in the manner evident in FIG. 2, and can be filled with a treatment fluid Fl, e.g. a washing fluid, up to filling level 6.

A drum, designated as a whole as 10, is mounted in container 5, and is supported on a drum shaft 15 structured as a hollow shaft. The circumference of drum 10 is made up of closely spaced, axis-parallel rods 11, which are structured as sealed pipes and are supported on drum shaft 15 on three carrier disks 12, 13, 14, which are perpendicular to the axis. Rods 11 together form a cylindrical sheath surface, around which a web W is looped in the manner evident in FIG. 2. The looping angle is approximately 3000 in the exemplary embodiment, i.e. the entire bottom part of web W rests on drum 10 and is thereby immersed in treatment fluid Fl. The large looping angle is brought about by two deflection rollers 16, 17 which are arranged parallel to the drum axis and adjacent to one another, directly above drum 10. In the exemplary embodiment, these are arranged symmetrically above drum 10. However, an arrangement displaced to the side is also possible. An asymmetrical arrangement can have an advantageous effect on the treatment process, because intimate contact between web W and drum 10 is achieved under the effect of gravity, due to the weight of web 10, in the upper region of the drum, and therefore the exchange of bath in web W is increased. Above deflection rollers 16, 17, at a greater distance from one another, two additional deflection rollers 18, 19 are also provided in machine frame 1, via which web W is passed into and out of the device in the direction of the arrow, and which can also be structured as spreading rollers or devices.

Container 5 has essentially flat face walls 7, 8 at its ends located in the axis direction of drum shaft 15, arranged close to frame cheeks 1' and 1", through which ends 15', 15" of drum shaft 15 pass. Ends 15', 15" reach into the region of frame cheeks 1', 1".

The passage locations of drum shaft 15 through face walls 7, 8 are sealed with seal arrangements 9, which are structured as axial face seals in the exemplary embodiment, which permit a slight displacement of drum shaft 15 perpendicular to its axis, relative to face walls 7, 8.

Drum shaft 15 has an eccentric shaft 20 passing through it over its length, which projects beyond drum shaft 15 at its ends, where it is mounted to rotate around an axis A, on fixed pivot bearings 21, 22 affixed on the outside of frame cheeks 1', 1". A gear motor 23 serves to drive eccentric shaft 20.

Axially inside pivot bearings 21, 22, eccentric shaft 20 has cylindrical regions 24, 25 which are offset eccentrically in the same direction, opposite ends 20', 20" of eccentric shaft 20, as is indicated by the double axis line at the level of regions 24, 25.

Ends 15', 15" of drum shaft 15 are mounted to rotate on regions 24, 25, via pivot bearings 26, 27. Hence, if therefore eccentric shaft 20 rotates relative to drum shaft 15, it performs an eccentric movement relative to axis A of the eccentric shaft, i.e. drum 10 is displaced parallel to itself, by an amount which corresponds to the eccentricity, into container 5. In general, an eccentricity of up to several millimeters is involved.

Equalization masses 28 are affixed on the side opposite the eccentricity, axially adjacent to eccentric regions 24, 25 of eccentric shaft 20 and inside; they ensure mass equalization of rotating eccentric shaft 20.

Drum 10 with drum shaft 15 is also driven in rotation. For this purpose, end 15' of drum shaft 15 bears a drive pulley 30, above which a corresponding drive pulley 31 is arranged, which is driven by a gear motor 29, whose journal forms a fixed bearing 29' for drive pulley 31. The drive is provided via endless, stretchably elastic pulling drive elements looped around drive pulleys 30, 31; in the exemplary embodiment, these drive elements are chosen to be round belts 32 which run adjacent to one another. Round belts 32 are pre-stressed and exert a certain upwardly directed force on end 15' of drum shaft 15, corresponding to part of the weight of drum 10 and drum shaft 15. This pre-stress not only makes it possible to transfer the drive torque, but also integrates pulling drive elements 32 into the vibration system, where they exert a damping effect.

On the opposite side, end 15" of drum shaft 15 located there is also suspended resiliently, specifically by means of tension springs 33, which are fixed in place in the top region of frame cheek 1" located there, and on which a bearing ring 34 is suspended, which is mounted on end 15" of drum shaft 15 via a ball bearing 35.

Drum 10 rotates relatively slowly compared with the speed of the web, i.e. at a speed on the order of 30 rpm at a web speed of 100 m/min, for example. Eccentric shaft 20, on the other hand, rotates rather quickly, i.e. at 500 or 800 rpm. It therefore generates a vibrating movement of drum 10 perpendicular to its axis. This results in rather strong vibrations, which are to be equalized or damped within device 100, if possible. For this purpose, several of the developments described work together. Rods 11 and drum shaft 15 are hollow and sealed, so that no treatment fluid can penetrate into them. Drum 10 is immersed in treatment fluid Fl to such an extent, during operation, that it just looks out at the top. At this immersion depth, rods 11 and drum 15 develop a buoyancy that amounts to approximately 80% of the weight of drum 10 and drum shaft 15 (outside of the treatment fluid). The remaining 20% of the weight is carried by the round belts 32 and springs 33, so that the weight of drum 10 and drum shaft 15 is essentially equalized and there is no stress on bearings 26, 27.

Still another point is equalization weights 28, which equalize the eccentricity of regions 24, 25, and ensure smooth running of rapidly rotating eccentric shaft 20.

Another point is the elastic suspension of drum shaft 15 on elements 32 and 33, which provide damping of the vibrations caused by the eccentric movement of drum shaft 15. The elastic stretchability of round belts 32 also permits transfer of the drive force for drum 10 from a fixed drive pulley 31 to drive pulley 30 which moves back and forth in accordance with the eccentricity.

Figure 2:
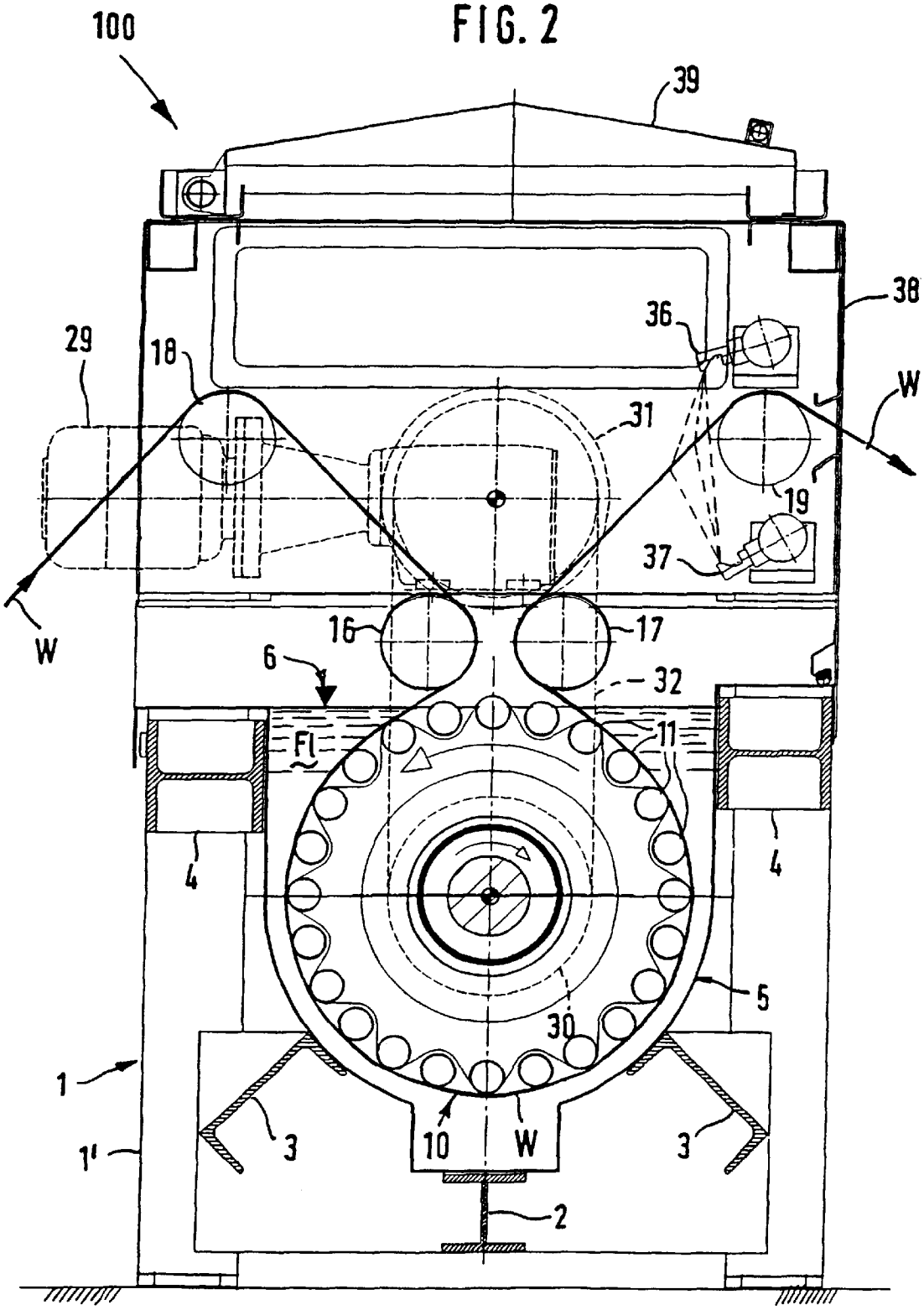
FIG. 2 shows a cross-section along line II—II in FIG. 1.

As is evident from FIG. 2, spray nozzles 36, 37 can be provided opposite one another on both sides of web W, in the region of deflection roller 19 adjacent to the exit area. The entire top part of the treatment device is surrounded by a sheet-metal housing 38 and a cover 39, in order to avoid heat losses and to prevent the treatment fluid from being sprayed out.

What is claimed is:

1. A treatment device for treating a continuously moving web, comprising:

a machine frame;

a container supported in the machine frame, to hold a treatment fluid;

a drum rotatably located within the container, so that it is largely immersed in the treatment fluid, the drum having a cylindrical, fluid-permeable circumference, at the bottom of which the web rests against a region of the drum which is immersed in treatment fluid, the web wrapping about the drum with a looping angle of at least 270°;

a driven eccentric shaft which is hollow and rotationally mounted in fixed external bearings;

a drum shaft having a first end and a second end, that carries the drum, eccentrically mounted on the eccentric shaft, and which surrounds the eccentric shaft, the drum shaft being rotationally mounted at its ends on regions of the eccentric shaft that are eccentric to the axis of rotation of the eccentric shaft;

wherein the drum shaft is supported on the machine frame at both ends, in elastically resilient manner, in a plane perpendicular to its axis.

2. The treatment device according to claim 1, wherein the fluid-permeable circumference of the drum is formed by axis-parallel, hollow, sealed rods arranged closely adjacent to one another, and the hollow drum shaft is sealed to prevent the entry of treatment fluid.

3. The treatment device according to claim 2, wherein the drum shaft carries a drive pulley at the first end, a corresponding drive pulley, connected to rotate with a motor, is mounted in a fixed bearing above a drive pulley, in machine frame, and an endless, stretchably elastic pulling drive element loops around the two drive pulleys.

4. The treatment device according to claim 3, wherein the drum shaft carries a ball bearing at the second end, and the ball bearing is supported on the machine frame via springs, in a plane perpendicular to its axis.

5. The treatment device according to claim 4, wherein a bearing ring is suspended on the machine frame on the springs.

6. The treatment device according to claim 2, wherein the volume of the drum shaft and the rods which is immersed in the treatment fluid is sized in such a way that at the immersion depth normal in operation, the buoyancy is 70 to 90% of the weight of the drum and the drum shaft, while the remaining weight is carried by a stretchably elastic pulling drive element at the first end and springs at the second end of the drum shaft.

7. The treatment device according to claim 1, wherein the drum shaft carries a drive pulley at the first end, a corresponding drive pulley, connected to rotate with a motor, is mounted in a fixed bearing above a drive pulley, in the machine frame, and an endless, stretchably elastic pulling drive element loops around the two drive pulleys.

8. The treatment device according to claim 7, wherein the volume of the drum shaft and the rods which is immersed in the treatment fluid is sized in such a way that at the immersion depth normal in operation, the buoyancy is 70 to 90% of the weight of the drum and the drum shaft, while the remaining weight is carried by the stretchably elastic pulling drive element at the first end and springs at the second end of the drum shaft.

9. The treatment device according to claim 8, wherein equalization masses to counteract the eccentricity of the eccentric shaft are provided on the eccentric shaft, close to eccentric regions.

10. The treatment device according to claim 1, wherein equalization masses to counteract the eccentricity of the eccentric shaft are provided on the eccentric shaft, close to eccentric regions.

* * * * *

UNITED STATES PATENT AND TRADEMARK OFFICE

CERTIFICATE OF CORRECTION

PATENT NO. : 6,257,028 B1
DATED : July 10, 2001
INVENTOR(S) : Dieter Russkamp

It is certified that error appears in the above-identified patent and that said Letters Patent is hereby corrected as shown below:

Column 2,
Line 65, change "3000" to -- 300 º --.

Signed and Sealed this

Fourth Day of June, 2002

*Attest:*

*Attesting Officer*

JAMES E. ROGAN
*Director of the United States Patent and Trademark Office*